US008244152B2

(12) United States Patent
Uehashi

(10) Patent No.: US 8,244,152 B2
(45) Date of Patent: Aug. 14, 2012

(54) DEVELOPING DEVICE AND IMAGE FORMING APPARATUS

(75) Inventor: Tetsuya Uehashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 444 days.

(21) Appl. No.: 12/625,791

(22) Filed: Nov. 25, 2009

(65) Prior Publication Data

US 2010/0129109 A1 May 27, 2010

(30) Foreign Application Priority Data

Nov. 27, 2008 (JP) ..... 2008-303187

(51) Int. Cl.
*G03G 15/08* (2006.01)

(52) U.S. Cl. ..... 399/103

(58) Field of Classification Search ..... 399/103, 399/102, 239, 278, 288
See application file for complete search history.

(56) References Cited

U.S. PATENT DOCUMENTS 6,009,287 A * 12/1999 Goldie ..... 399/103
6,834,170 B2 * 12/2004 Choi et al. ..... 399/103
8,068,773 B2 * 11/2011 Uehashi ..... 399/288
2003/0026629 A1 * 2/2003 Kawamura et al. ..... 399/281
2005/0220503 A1 * 10/2005 Asakura ..... 399/288
2010/0329749 A1 * 12/2010 Uehashi ..... 399/288

FOREIGN PATENT DOCUMENTS

JP 06-035381 A 2/1994

* cited by examiner

*Primary Examiner* — David Gray
*Assistant Examiner* — Rodney Bonnette
(74) *Attorney, Agent, or Firm* — Marvin A. Motsenbocker; Mots Law, PLLC

(57) ABSTRACT

A developing device includes: an image carrier, a developer carrier configured to carry developer and develop a latent image formed on the image carrier to form a developer image on the image carrier, a developer supplying member being in contact with the developer carrier and configured to supply the developer to the developer carrier, and developer sealing members provided at the ends of the developer carrier and the developer supplying member and configured to seal the developer there-between. One of the developer carrier and the developer supplying member is a belt member stretched between a drive roller and a driven roller. The developer sealing members are in contact with the outer circumferential surface of the belt member.

8 Claims, 6 Drawing Sheets

DEVELOPING DEVICE AND IMAGE FORMING APPARATUS

CROSS REFERENCE TO RELATED APPLICATIONS

This application claims priority based on 35 USC 119 from prior Japanese Patent Application No. P2008-303187 filed on Nov. 27, 2008, entitled "DEVELOPING DEVICE AND IMAGE FORMING APPARATUS", the entire contents of which are incorporated herein by reference.

BACKGROUND OF THE INVENTION

1. Field of the Invention

The invention relates to a developing device and an image forming apparatus.

2. Description of Related Art

In an image forming apparatus such as a printer, copy machine, facsimile machine, MFP (multifunctional Peripheral), for example, in a printer, a charging roller charges the surface of a photosensitive drum, a LED head emits light to form an electrostatic latent image on the surface of the photosensitive drum, a developing device having a developing roller serving as a developer carrier electrostatically supplies a toner layer serving as a developer layer formed on the developing roller to the surface of the photosensitive drum so as to develop the electrostatic latent image to form a toner image, a transfer roller transfers the toner image onto a medium, and a fixing unit fixes the toner image on the medium so as to form a permanent image on the medium.

In order to supply the toner to the developing roller, there is a belt-type toner supplying device. Such a belt-type toner supplying device includes a drive roller, a driven roller, and a toner supplying belt stretched between the drive roller and the driven roller. A voltage is applied to the drive roller to produce an electric field for supplying toner from the toner supplying belt to the developing roller, and a voltage is applied to the driven roller to produce an electric field for removing toner remaining on the developing roller after the development process (see, for example, Japanese Patent Application Laid-Open No. H6-35381).

SUMMARY OF THE INVENTION

In such a conventional developing device, if the toner leaks through the open ends of the toner supplying belt into the space inside the toner supplying belt and between the toner supplying belt and the drive roller or the driven roller, the drive roller or the driven roller can not produce an electric field of adequate strength. Accordingly, the toner can not be supplied from the toner supplying belt to the developing roller in an adequate amount, or the toner remaining on the developing roller after the developing process can not be removed from the developing roller to the toner supplying belt in an adequate amount. This may deteriorate the image quality.

A first aspect of the invention is a developing device including: an image carrier, a developer carrier configured to carry developer and develop a latent image formed on the image carrier to form a developer image on the image carrier, a developer supplying member being in contact with the developer carrier and configured to supply the developer to the developer carrier, and developer sealing members provided at the ends of the developer carrier and the developer supplying member and configured to seal the developer, wherein one of the developer carrier and the developer supplying member is a belt member stretched between a drive roller and a driven roller, and wherein the developer sealing members are in contact with the outer circumferential surface of the belt member.

A second aspect of the invention is an image forming apparatus including a developing device. The developing device includes: an image carrier, a developer carrier configured to carry developer and develop a latent image formed on the image carrier to form a developer image on the image carrier, a developer supplying member being in contact with the developer carrier and configured to supply the developer to the developer carrier, and developer sealing members provided at the ends of the developer carrier and the developer supplying member and configured to seal the developer therebetween, wherein one of the developer carrier and the developer supplying member is a belt member stretched between a drive roller and a driven roller, and wherein the developer sealing members are in contact with the outer circumferential surface of the belt member.

According to the aspects of the invention, at the ends of the developer carrier and developer supplying member, the developer sealing members abut against the outer circumferential surface of the belt member to seal the developer. Thereby, the developer or other extraneous material is prevented from leaking through the open ends of the belt member into contact between the belt member and the drive roller or the driven roller. Therefore, either of the drive roller or the driven roller can produce an electric field of adequate strength. Consequently, a developer can be supplied from the developer supplying member to the developer carrier in an adequate amount and the developer remaining on the developer carrier after the developing process can be adequately retrieved from the developer carrier to the developer supplying member. This prevents image quality deterioration.

DETAILED DESCRIPTION OF EMBODIMENTS

Figure 1:
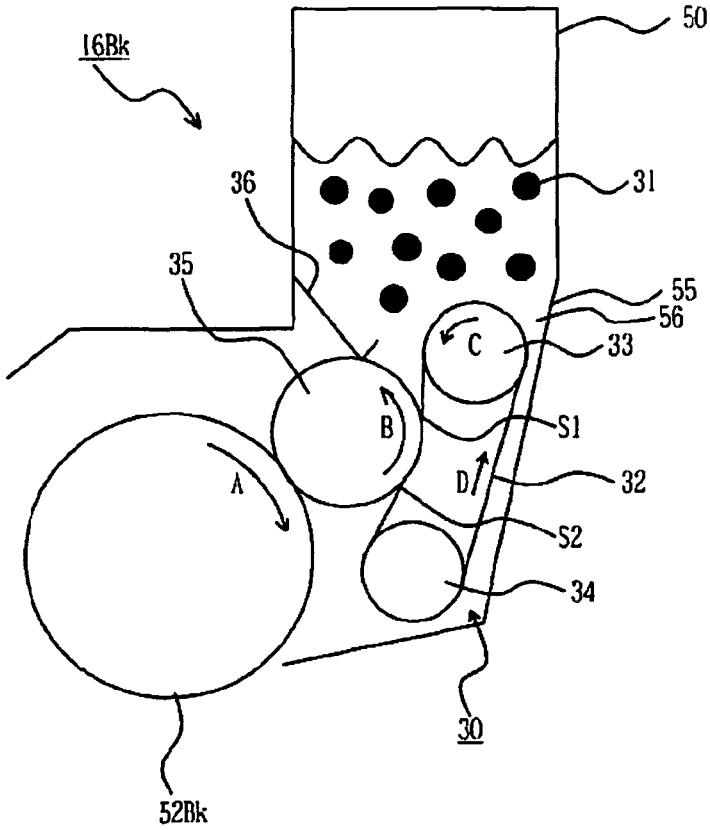
FIG. 1 is a side view of an image forming unit of a first embodiment according to the invention.

Hereinafter, embodiments according to the invention will be described in detail with reference to the drawings. In the respective drawings referenced herein, the same constituents are designated by the same reference numerals and duplicate explanation concerning the same constituents is basically omitted. The following embodiments describe a color printer serving as a image forming apparatus.

Figure 2:
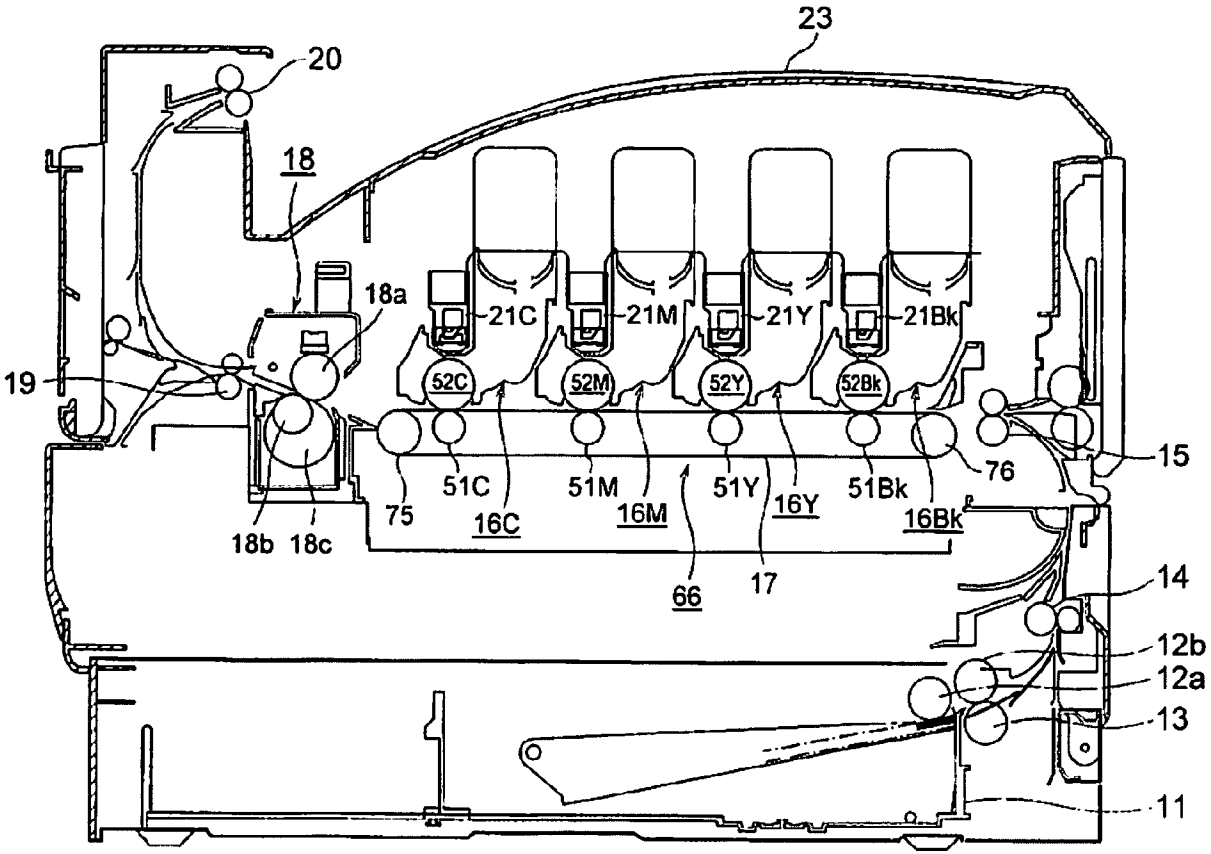
FIG. 2 is a conceptual diagram of a printer of the first embodiment.

FIG. 2 is a conceptual diagram of a printer of a first embodiment according to the invention.

As shown in FIG. 2, the printer has, at the lower portion of the body of the printer, paper cassette 11 serving as a media container that contains paper (not shown) serving as a medium and a paper feeding unit or a paper feeding mechanism provided adjacent to the front side of paper cassette 11. The paper feeding mechanism feeds sheets of paper one by one from paper cassette 11 to the medium transport path. The paper feeding mechanism includes paper feeding rollers 12*a*, 12*b* and separating roller 13. Paper feeding rollers 12*a* and 12*b* are driven to rotate by a paper feeding motor serving as a driver for the paper feeding mechanism. When paper feeding rollers 12*a* and 12*b* rotate, paper is conveyed from paper cassette 11 to a pair of conveying rollers 14 serving as a print timing adjusting part provided above the paper feeding mechanism. The paper is conveyed to a pair of conveying rollers 15 and further conveyed to a passage between an array of image forming units 16Bk, 16Y, 16M, 16C serving as image forming parts and transferring unit 66 serving as a transferring device or a belt unit. Image forming units 16Bk, 16Y, 16M, 16C form developer images such as toner images of black, yellow, magenta and cyan color, respectively.

Transferring unit 66 includes drive roller 75 serving as a first roller, idle roller 76 serving as a second roller, transfer belt 17 serving as a first transfer member in the form of a belt member stretched between drive roller 75 and idle roller 76, transfer rollers 51Bk, 51Y, 51M, 51C serving as second transfer members, and belt motor (not shown) serving as a driver to rotate the drive roller 75. Transfer rollers 51Bk, 51Y, 51M, 51C are disposed opposite to photosensitive drums 52Bk, 52Y, 52M, 52C serving as image carriers in image forming units 16Bk, 16Y, 16M, 16C, respectively, in a manner such that transfer belt 17 is sandwiched between the transfer rollers and photosensitive drums. Transfer belt 17 also functions as a paper conveying member.

Transfer rollers 51Bk, 51Y, 51M, 51C transfer the respective color toner images from photosensitive drums 52Bk, 52Y, 52M, 52C of image forming units 16Bk, 16Y, 16M, 16C to paper in this order, to form a multiple color toner image on the paper.

Next, the paper is conveyed to fixing unit 18 serving as a fixing device. Fixing unit 18 heats the paper to fix the multiple-color toner image on the paper so as to produce a permanent multicolor image on the paper. Fixing unit 18 includes heating roller 18*a* serving as a first roller, pressure roller 18*b* serving as a second roller, fixing belt 18*c* enveloping pressure roller 18*b* and configured to be rotated by rollers 18*a* and 18*b*, and a halogen heating lamp (not shown) serving as a heater provided inside heating roller 18*a*.

The paper discharged from fixing unit 18 is conveyed by a pair of conveying rollers 19 and further conveyed by a pair of discharge rollers 20 thereby being discharged out of the body of the printer. As described above, color printing is accomplished.

Note that LED heads 21Bk, 21Y, 21M, 21C are provided opposite to photosensitive drums 52Bk, 52Y, 52M, 52C respectively. LED heads 21Bk, 21Y, 21M, 21C serves as exposure units to emit light onto the surfaces of the photosensitive drums 52Bk, 52Y, 52M, 52C so as to form latent images such as electrostatic latent images on the surfaces of the photosensitive drums 52Bk, 52Y, 52M, 52C.

Image forming units 16Bk, 16Y, 16M and 16C are detachable from the body of the printer. In order to detach image forming units 16Bk, 16Y, 16M and 16C from the body of the printer, the body of the printer is formed with body cover 23 to open or close an opening at the upper portion of the body of the printer. Note that LED heads 21Bk, 21Y, 21M, 21C are attached to and supported by the cover 23.

Next, image forming units 16Bk, 16Y, 16M and 16C will be described. Note that image forming units 16Bk, 16Y, 16M and 16C have the same configuration, so hereinafter only the configuration of image forming unit 16Bk will be described.

FIG. 1 is a side view of image forming unit 16Bk of the first embodiment.

As shown in FIG. 1, image forming unit 16Bk includes photosensitive drum 52Bk serving as a image carrier, developing roller 35 serving as a developer carrier, developer supplying device 30 that supplies toner 31 to developing roller 35, development blade 36 that forms a toner layer on the surface of developing roller 35, toner cartridge 50 serving as a developer container that contains fresh toner 31, and the like. Photosensitive drum 52Bk is driven to rotate in the direction of arrow A, and developing roller 35 is driven to rotate in the direction of arrow B.

Developing roller 35 and photosensitive drum 52Bk are disposed such that they are in contact with each other. At the point of contact between photosensitive drum 52Bk and developing roller 35, the surface of photosensitive drum 52Bk and the surface of developing roller 35 moves in the same direction. That is, the rotational direction (arrow A) of the developing roller 35 and the rotational direction (arrow B) of photosensitive drum 52Bk are opposite to one another. Developing roller 35 supplies toner to photosensitive drum 52 so as to develop the electrostatic latent image on the surface of photosensitive drum 52Bk thereby forming the toner image on the surface of photosensitive drum 52Bk. Developing roller 35 is formed from a metal shaft coated with an elastic layer. Note that the elastic layer is made of a silicone rubber having a volume resistivity of $10^8$ to $10^{12}$ [Ωcm].

Development blade 36 is formed from an flexible metal plate. Development blade 36 has a bent tip that abuts against the surface of developing roller 35 with a predetermined pressure. Developer chamber 56 containing toner 31 is formed beneath toner cartridge 50 in housing 55 of image forming unit 16Bk. Developer chamber 56 is sealed by development blade 36 at the upper portion and is sealed by a sealing member (not shown) provided between photosensitive drum 52Bk and housing 55 at the lower portion.

Developer supplying device 30 includes drive roller 33 serving as a first rotating member, driven roller 34 serving as a second rotating member, and toner supplying belt 32 serving as a developer supplying member in the form of a belt member stretched between drive roller 33 and driven roller 34 and being in contact with developing roller 35. Driven by the rotation (arrow C) of drive roller 33, toner supplying belt 32 moves in the direction of arrow D, while driving driven roller 34. Regarding toner supplying belt 32, point S1 is the contact starting point where developing roller 35 begins contacting toner supplying belt 32 and point S2 is the contact ending point where developing roller 35 ends contact with toner supplying belt 32.

Developer supplying device 30 (toner supplying belt 32) is in contact with developing roller 35. Developer supplying device 30 (toner supplying belt 32) is driven to rotate in the same direction (the direction of arrow D) as the rotation direction of developing roller 35, so that, at the contact between developer supplying device 30 (toner supplying belt 32) and developing roller 35, the surface of developer supplying device 30 (toner supplying belt 32) moves in the opposite direction with respect to the surface of developing roller 35.

Drive roller 33 and driven roller 34 are made of conductive material such as a metal. Toner supplying belt 32 is made of chloroprene rubber, urethane resin, polyimide resin, polyamide resin, urethane rubber, silicone rubber or the like, having a volume resistivity of $10^4$ to $10^7$ [Ωcm]. The surface of toner supplying belt 32 has a sandblasted, coated, or knurled finish or the like, for high conveying performance.

Next, the operation of image forming unit 16Bk having the above configuration will be described.

Upon starting the image forming operation, photosensitive drum 52Bk, developing roller 35 and drive roller 33 are driven to rotate by a driving device (not shown). Toner supplying belt 32 runs in the direction of arrow D while conveying toner 31 that is supplied from toner cartridge 50 and adhered to the outer circumferential surface thereof. An attachment force that attaches toner 31 to the outer circumferential surface of the toner supplying belt 32 includes Van der Waals' forces, small Coulomb's force caused by the surface roughness of toner supplying belt 32 and the like. Toner 31 is stirred by a stirring member (not shown) or the like so as to become triboelectrically charged. The attachment force may therefore also include an electrostatic component.

A voltage for producing an adequate electric field to attract toner from toner supplying belt 32 to developing roller 35 at contact starting point S1 is applied to drive roller 33. Therefore, at contact starting point S1, toner 31 attached on toner supplying belt 32 is supplied to developing roller 35. As developing roller 35 rotates, toner 31 supplied to developing roller 35 passes by development blade 36 and is metered by development blade 36 to a uniform thickness. Toner 31 having the uniform thickness comes in contact with photosensitive drum 52Bk and is supplied to photosensitive drum 52Bk to develop the electrostatic latent image on photosensitive drum 52Bk to form the toner image on photosensitive drum 52Bk.

As developing roller 35 rotates, toner 31 that remains on developing roller 35 after forming the toner image is conveyed toward contact ending point S2 of toner supplying belt 32. At contact ending point S2, toner 31 remaining on developing roller 35 is withdrawn to toner supplying belt 32 by a voltage applied to driven roller 34. The voltage is applied to produce an adequate electric field to attract toner 31 from developing roller 35 to toner supplying belt 32 at contact ending point S2. Such a supply and withdrawal of toner 31 between developing roller 35 and toner supplying belt 32 occurs continuously during the developing process.

Figure 3:
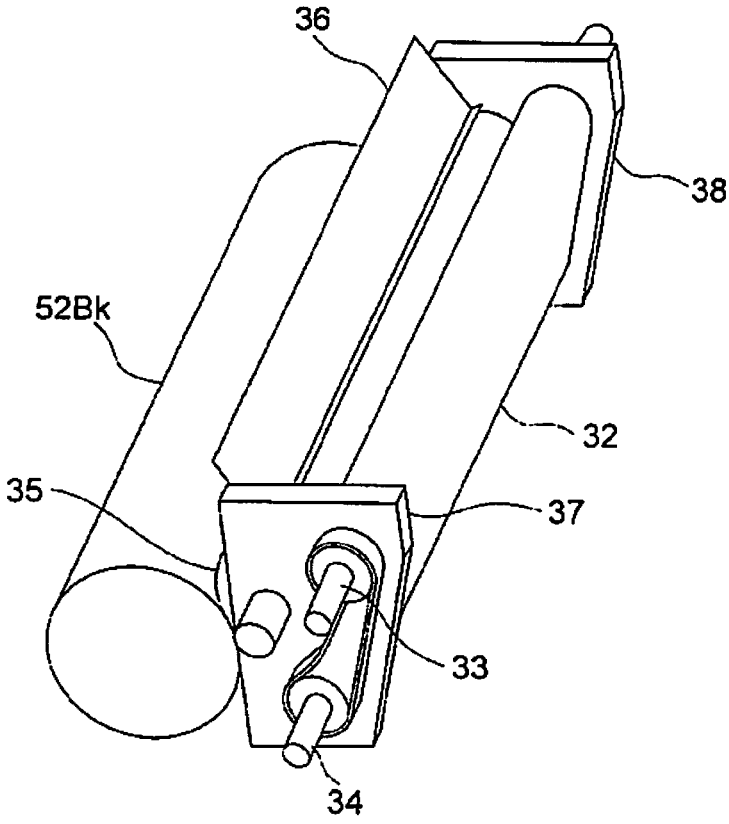
FIG. 3 is a perspective view of the image forming unit of the first embodiment.

FIG. 3 is a perspective view of the image forming unit of the first embodiment.

In the embodiment the width of toner supplying belt 32 is greater than the width of developing roller 35 along the axis of photosensitive drum 52Bk.

Toner sealing member 37 serving as a developer sealing member is provided at one end of developing roller 35, development blade 36, and toner supplying belt 32. Toner sealing member 38 serving as a developer sealing member is provided at the other end of developing roller 35, development blade 36, and toner supplying belt 32. Toner sealing members 37, are respectively in contact with the end faces of the development blade 36 and respectively in contact with the end faces of developing roller 35. Also toner sealing members 37, 38 are in contact with the entire outer circumferential face of toner supplying belt 32 in the vicinity of the ends of the toner supplying belt 32. Toner sealing members 37, 38 are, for example, made of foamed polyurethane, a foamed silicone or the like, or made of a bi-layer structure having a base layer and a felt-like or brush-like surface layer.

Note that the developing device is composed of photosensitive drum 52Bk, toner supplying belt 32, developing roller 35 and toner sealing members 37, 38 in this embodiment.

As described above, toner sealing members 37 and 38 abut against the end faces of development blade 36 and against the end faces of developing roller 35, and abut on the outer circumferential surface of toner supplying belt 32 in the vicinity of the ends of toner supplying belt 32. In this configuration, toner sealing members 37 and 38 seal toner there-between. In other words, toner sealing members 37 and 38 prevent toner 31 attached on toner supplying belt 32 and developing roller 35 and toner 31 around toner supplying belt 32 and developing roller 35 from leaking from toner supplying belt 32 in the widthwise outside direction.

Therefore, toner 31 or other extraneous material is prevented from leaking through the open ends of toner supplying belt 32 into the space between toner supplying belt 32 and drive roller 33 or driven roller 34. Consequently, drive roller 33 and driven roller 34 each can continue producing adequate electrical field, so that toner 31 can be supplied to developing roller 35 in an adequate amount and toner 31 remaining on developing roller 35 after the developing process can be withdrawn to toner supplying belt 32 in an adequate amount. This improves the image quality.

Note that although the open ends of toner supplying belt 32 are not closed in this embodiment, frame or wall members may be in contact with the open ends of toner supplying belt 32 to close the open ends so as to prevent toner 31 or other extraneous material from leaking through the open ends of toner supplying belt 32 into the space between toner supplying belt 32 and drive roller 33 or driven roller 34.

Next, a second embodiment according of the invention will be described. Note that in the second embodiment the same configuration as that of the first embodiment is designated by the same reference numerals and, the description of the same effect as that of the first embodiment due to the same configuration will be omitted.

Figure 4:
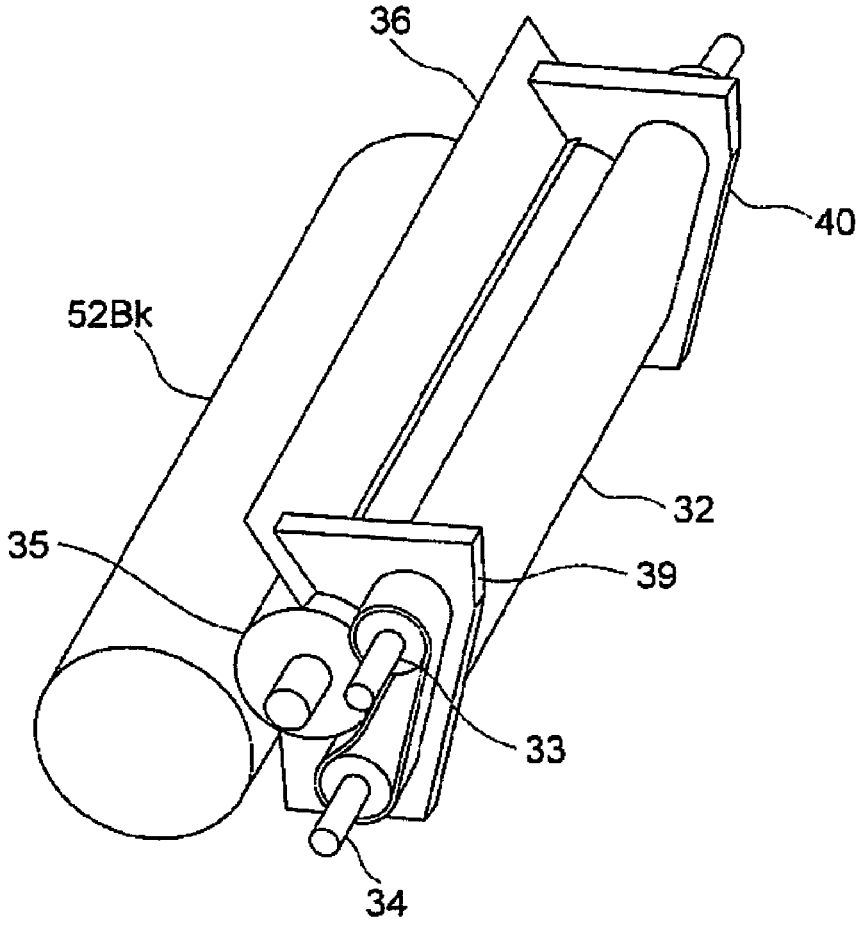
FIG. 4 is a perspective view of an image forming unit of a second embodiment according to the invention.

FIG. 4 is a perspective view of the image forming unit of the second embodiment.

In this embodiment, toner sealing members 39 and 40 serving as developer sealing members are provide respectively at the ends of developing roller 35 serving as a developer carrier, development blade 36, and toner supplying belt 32 serving as a belt member. Toner sealing members 39, 40 are in contact with the face of development blade 36 (that is, the face on the side where toner serving as developer is supplied from developer supplying device 30) in the vicinity of the outside ends of the development blade 36 and are in contact entirely with the outer circumferential surface of toner supplying belt 32 other than a contact between toner supplying belt 32 and developing roller 35, in the vicinity of the outside ends of toner supplying belt 32 and developing roller 35.

Toner 31 that is attached to toner supplying belt 32 and developing roller 35 and toner 31 around toner supplying belt 32 and developing roller 35, is sealed between toner sealing members 39 and 40.

Therefore, toner 31 or other extraneous material is prevented from leaking through the open ends of toner supplying belt 32 into the space between toner supplying belt 32 and drive roller 33 serving as a first rotating member or driven roller 34 serving as a second rotating member. Drive roller 33 and driven roller 34 each can produce an electric field of adequate strength. Consequently, toner can be supplied to developing roller 35 in an adequate amount, and toner remaining on developing roller 35 after the developing process can be withdrawn to toner supplying belt 32 in an adequate amount. This improves the image quality.

Next, a third embodiment according to the invention will be described. Note that in the third embodiment configurations the same as those of the first and second embodiment are designated by the same reference numerals and, the description of the same effects as those of the first embodiment due to the same configurations will be omitted.

Figure 5:
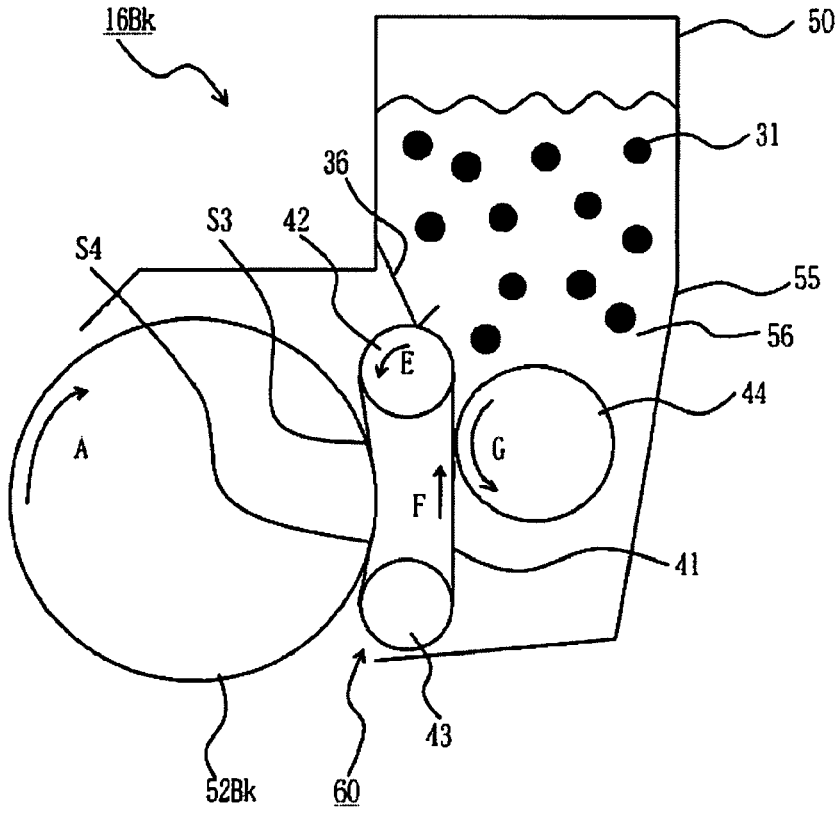
FIG. 5 is a side view of an image forming unit of a third embodiment according to the invention.

FIG. 5 is a side view of the image forming apparatus of the third embodiment.

As shown in FIG. 5, image forming unit 16Bk serving as an image former includes: photosensitive drum 52Bk serving as a image carrier, image carrying device 60, toner supplying roller serving as a developer supplying member that supplies toner 31 serving as developer to image carrying device 60, development blade 36 that forms a toner layer on the surface of image carrying device 60, toner cartridge 50 serving as a developer container that contains fresh toner 31, and the like.

Image carrying device 60 is disposed such that image carrying device 60 is in contact with photosensitive drum 52Bk. The rotational direction (a direction of arrow F) of image carrying device 60 and the rotational direction (a direction of arrow A) of photosensitive drum 52Bk are set opposite to each other, such that the surface of photosensitive drum 52Bk and the surface of image carrying device 60 move in the same direction at the contact between image carrying device 60 and photosensitive drum 52Bk. The image carrying device 60 develops a latent image such as an electrostatic latent image on the surface of photosensitive drum 52Bk to form a developer image such as a toner image.

Image carrying device 60 includes drive roller 42 serving as a first rotating member, driven roller 43 serving as a second rotating member, and developing belt 41 serving as a developer carrier in the form of a belt member that is stretched between drive roller 42 and driven roller 43 and in contact with photosensitive drum 52Bk. Developing belt 41 runs in a direction of arrow F due to the rotation of drive roller 42, and thereby rotating driven roller 43. A point S3 is a contact starting point where developing belt 41 starts to contact photosensitive drum 52Bk, and a point S4 is a contact ending point where developing belt 41 ends contact with photosensitive drum 52Bk.

Drive roller 42 and driven roller 43 are made of a conductive material such as metal or the like. Developing belt is made of a urethane rubber or the like having a volume resistivity of $10^4$ to $10^7$ [Ωcm]. Toner supplying roller 44 is formed from a metal shaft coated with a urethane rubber and having a volume resistivity of $10^7$ to $10^9$ [Ωcm]. Toner supplying roller 44 is disposed such that it is in contact with developing belt 41. Toner supplying roller 44 is driven to rotate in the same direction as the rotation direction (a direction of arrow F) of developing belt 41, so that the surface of developing belt 41 and the surface of toner supplying roller 44 run opposite to each other at the contact between toner supplying roller 44 and developing belt 41.

Next, the operation of image forming unit 16Bk having the above configuration will be described.

Upon starting the image forming operation, photosensitive drum 52Bk, drive roller 42 and toner supplying roller 44 are driven to rotate by a driving device, so that developing belt 41 runs in the direction of arrow F. Toner supplying roller 44 supplies toner 31 from toner cartridge 50 to developing belt 41. Developing belt 41 conveys toner 31 that is supplied from toner supplying roller 44 and attached on the outer circumferential surface of developing belt 41.

More specifically a voltage for producing an adequate electric field to attract toner from toner supplying roller 44 to developing belt 41 at contact starting point S3 is applied to drive roller 42. Therefore, at contact starting point S3, toner attached to toner supplying roller 44 is supplied to developing belt 41. As developing belt 41 runs, toner 31 supplied to developing belt 41 passes by development blade 36 and is thereby metered to a uniform thickness by development blade 36. Toner 31 having the uniform thickness comes in contact with photosensitive drum 52Bk to be supplied to photosensitive drum 52Bk and develop the electrostatic latent image on photosensitive drum 52Bk to form a toner image on photosensitive drum 52Bk.

As developing belt 41 rotates, toner 31 that remains on developing belt 41 after forming the toner image is conveyed toward contact ending point S4 of developing belt 41. At contact ending point S4, toner 31 remaining on developing belt is withdrawn to toner supplying roller 44 by a voltage applied to driven roller 43. The voltage is applied to produce an adequate electric field to attract toner 31 from developing belt 41 to toner supplying roller 44 at contact ending point S4.

Such a supply and withdrawal of toner 31 between developing belt 41 and toner supplying roller 44 occurs continuously during the developing process.

Figure 6:
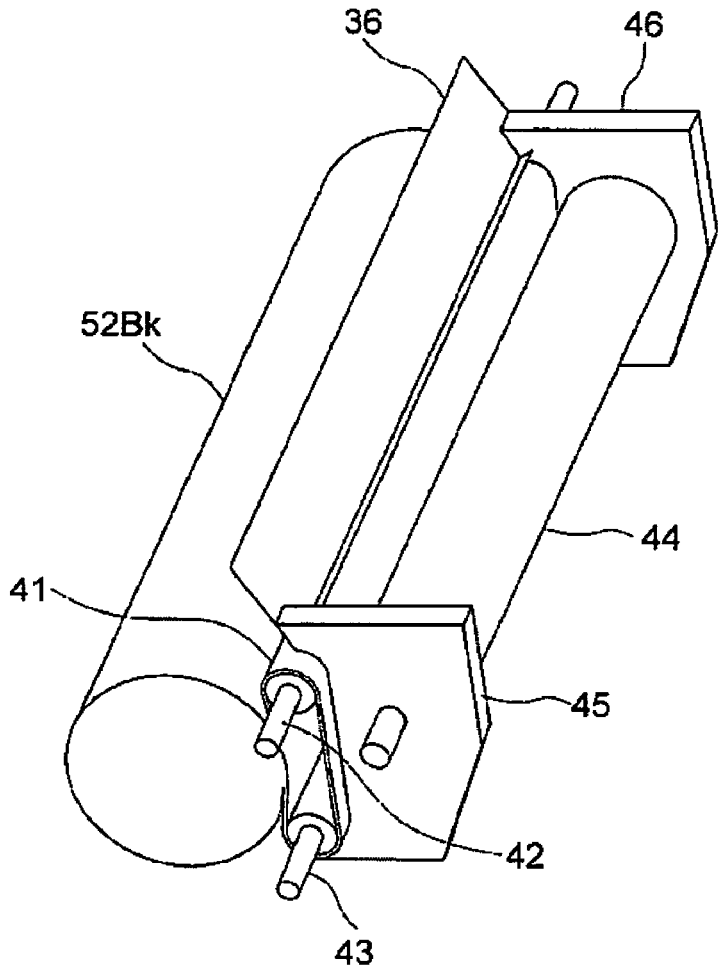
FIG. 6 is a perspective view of the image forming unit of the third embodiment.

FIG. 6 is a perspective view of the image forming unit of the third embodiment.

In the third embodiment the width of developing belt 41 is larger than the width of toner supplying roller 44 along the axis of photosensitive drum 52Bk.

Toner sealing member 45 serving as a developer sealing member is provided at one end of development blade 36 and toner supplying roller 44. Toner sealing member 46 serving as a developer sealing member is provided at the other end of development blade 36 and toner supplying roller 44. Toner sealing members 45 and 46 abut respectively against the end faces of development blade 36 and the end faces of toner supplying roller 44. In the vicinity of each end of developing belt 41, each of toner sealing members 45 and 46 is in contact with the outer circumferential surface of developing belt 41 on the side of developer chamber 56.

As described above, toner sealing members 45 and 46 contact with the end faces of development blade 36 and toner supplying roller 44, and contact the outer circumferential surface of developing belt 41 in the vicinity of the ends of developing belt 41. Therefore, toner 31 attached to developing belt 41 and toner supplying roller 44 and toner 31 around developing belt 41 and toner supplying roller 44 are sealed between toner sealing members 45 and 46.

Thus, toner 31 or other extraneous material is prevented from leaking through the open ends of developing belt 41 into the space between developing belt 41 and drive roller 42 or driven roller 43. Consequently, drive roller 42 and driven roller 43 can produce an electric field of adequate strength so that toner 31 can be supplied to developing belt 41 in an adequate amount and toner 31 remaining on developing belt 41 can be withdrawn to toner supplying roller 44 in an adequate amount. This improves the image quality.

Although the above embodiments describe a color printer serving as image forming apparatus, the invention can be applied in a black and white printer, facsimile machine, MFP (Multifunctional Peripheral) or the like having a photosensitive drum.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A developing device comprising:

an image carrier, a developer carrier configured to carry developer and develop a latent image formed on the image carrier to form a developer image on the image carrier, a developer supplying member being in contact with the developer carrier and configured to supply the developer to the developer carrier, wherein one of the developer carrier and the developer supplying member is a belt member stretched between a drive roller and a driven roller, and developer sealing members provided at both ends of the developer carrier and the developer supplying member and configured to seal the developer there-between, the developer sealing members being in contact with an outer circumferential surface of the belt member.

2. The developing device according to claim 1, wherein the developer supplying member is the belt member, and the developer supplying member is longer than the developer carrier along an axis of the image carrier.

3. The developing device according to claim 1, wherein the developer carrier is the belt member, and the developer carrier is longer than the developer supplying member along an axis of the image carrier.

4. The developing device according to claim 1, further comprising a development blade being in contact with the developer carrier to meter the developer on the developer carrier to a uniform thickness.

5. The developing device according to claim 1, further comprising a developer container that contains fresh developer that is to be supplied to the developer supplying member.

6. An image forming apparatus comprising the developing device according to claim 1.

7. The image forming apparatus according to claim 6, further comprising an exposure unit configured to emit light to form a latent image on the image carrier.

8. The image forming apparatus according to claim 6, further comprising:

a transferring unit configured to transfer the developer image formed on the image carrier to a medium; and a fixing unit configured to heat the medium to fix the developer image to the medium.

* * * * *